US010907946B1

(12) United States Patent
Lier et al.

(10) Patent No.: US 10,907,946 B1
(45) Date of Patent: Feb. 2, 2021

(54) OSCILLATING PRIMER FEED SYSTEM FOR RELOADING AMMUNITION CARTRIDGES

(71) Applicant: Lyman Products Corporation, Middletown, CT (US)

(72) Inventors: Peter Vincent Lier, Hamden, CT (US); Martin Stark, Sherborn, MA (US); Dmytro Yaremenko, Fort Myers, FL (US)

(73) Assignee: Lyman Products Corporation, Middletown, CT (US)

( * ) Notice: Subject to any disclaimer, the term of this patent is extended or adjusted under 35 U.S.C. 154(b) by 0 days.

(21) Appl. No.: 16/738,604

(22) Filed: Jan. 9, 2020

(51) Int. Cl.
*F42B 33/00* (2006.01)
*F42B 33/04* (2006.01)

(52) U.S. Cl.
CPC ..... *F42B 33/002* (2013.01); *F42B 33/04* (2013.01)

(58) Field of Classification Search
CPC ..... F42B 33/002; F42B 33/04
USPC ..... 86/45
See application file for complete search history.

(56) References Cited

U.S. PATENT DOCUMENTS 2,413,047 A * 12/1946 Huddleson ..... 86/23
2,521,842 A * 9/1950 Foster ..... F42B 33/04 86/1.1
3,748,950 A * 7/1973 Huntington ..... F42B 33/04 86/24
3,973,465 A * 8/1976 Bachhuber ..... F42B 33/04 86/45
4,223,588 A * 9/1980 Simpson ..... F42B 33/002 86/23
4,632,008 A 12/1986 Horner
5,335,578 A * 8/1994 Lorden ..... F42B 33/002 86/25
5,747,718 A * 5/1998 Bill ..... F42B 33/00 29/525
7,497,155 B2 * 3/2009 Koskela ..... F42B 33/10 86/23
7,552,668 B1 * 6/2009 Gonzalez ..... F42B 33/00 86/45
9,689,651 B1 * 6/2017 Lee ..... F42B 33/002
9,982,982 B2 * 5/2018 Pruett ..... F42B 33/001

OTHER PUBLICATIONS

Dillon Primer Flip Tray (Printout of Dillon Primer Flip Tray offered at Dillon Precision Jan. 9, 2020).
Dillon RF Auto Primer Filler (Printout of Dillon RF Auto Primer Filler offered at Dillon Precision Jan. 9, 2020).
Lyman Primer Tray (Printout of Lyman Primer Tray offered at Cabel s Jan. 9, 2020).
RCBS Primer Tray-2 (Printout of RCBS Primer Tray-2 offered at RCBS Jan. 9, 2020).

* cited by examiner

*Primary Examiner* — Samir Abdosh
(74) *Attorney, Agent, or Firm* — St Onge Steward Johnston & Reens LLC

(57) ABSTRACT

A primer feed system, includes a feed bowl having a first end and a second end, an oscillation mechanism coupled to the feed bowl for imparting an oscillating movement to the feed bowl, and a feed ramp coupled to the second end of the feed bowl for supplying primers from the feed bowl to a cartridge reloading device, and at least one primer position sensor positioned adjacent the feed ramp, wherein the primer position sensor senses orientation of primers in the feed ramp.

23 Claims, 9 Drawing Sheets

OSCILLATING PRIMER FEED SYSTEM FOR RELOADING AMMUNITION CARTRIDGES

FIELD OF THE INVENTION

The technology relates to the field of loading and reloading ammunition cartridges. More specifically, the technology relates to an automated oscillating primer feed system for orienting primers in a proper position before they are inserted into a casing that will be loaded with gunpowder and a bullet to form a complete cartridge.

BACKGROUND OF THE INVENTION

An ammunition cartridge typically includes a bullet (also called a projectile), a cylindrical casing or shell, a propellant (typically smokeless powder), and a primer. Generally, the bullet is cylindrical and has a hollow, round, or flat point on one end. The other end of the bullet is flat or boat-tailed, fits the casing, and is held by the forward open end of the casing until the bullet is fired. The rear end of the casing has a washer shaped round rim. The hole in the center of the rim houses the primer. In use, the cartridge is held within the chamber of the firearm. When the bullet is discharged by a pin impacting the primer (each time the trigger of the firearm is pulled), the firearm can eject the spent cartridge and (in the case of semi-automatic operation) loads another, fresh cartridge into the chamber of the firearm.

OEM manufacturers of ammunition load new ammunition cartridges with a primer, propellant and bullet and sell them to shooting sports participants.

Individuals who are shooting sports enthusiasts often prefer to load or reload their own cartridges instead of purchasing commercially made new cartridges. Accordingly, such persons may purchase new casings and load them or reload previously used casings. Loading and reloading allows the user to select the particular bullet, propellant and primer to suit the user's preferences. Reloading of spent casings with a new primer, powder and bullet is an economic alternative to purchasing new ammunition, and provides an enjoyable hobby.

A sequence of several steps is involved in reloading a spent cartridge. The sequence must be followed carefully in order to produce a usable, reloaded cartridge safely. The steps of reloading typically involve:

- Casing cleaning
- Spent primer removal
- Casing resizing
- Casing length measurement and trimming
- Casing mouth deburring, reaming, champfer and size check
- Primer pocket cleaning and resizing
- Primer seating in primer pocket
- Powder measurement and place in casing
- Bullet seating in casing mouth and crimp in place if needed The reloading steps may be implemented using manual hand tools or manually activated or motorized presses.

The reloading of cartridges occurs in a succession of processing cycles. Each of the cycles includes a processing segment and a relocating segment. During the processing segment of each of the cycles, each of the casings is located at a stationary position at one of the processing stations where the steps of the reloading are performed. During the relocating segment of each cycle that follows the processing segment, all of the casings are moved simultaneously to the next stations. To do this, some reloaders include a rotating casing plate that holds the cartridges that are being processed. During the processing segment of each cycle, a spent casing is placed at a first processing station of the reloader and at other stations the casing is restored back to original specifications, propellant is added, a new primer is added, a bullet is added, and the casing is crimped to hold the bullet in place. After the processing segment of the cycle has been completed, and as the relocating segment of the cycle proceeds, the reloaded cartridge that was being processed at the final processing station is ejected from the reloader. At some of the processing stations, some of the steps can be performed manually or automatically or a combination of both.

Reloading equipment may include several processing stations arranged at fixed positions in a circle or a line. At each of the processing stations, one of the steps of the sequence is performed. As the casing is being subjected to each of the steps at the respective processing stations, other casings are typically being processed simultaneously to complete other steps of the sequence at the other processing stations.

One of the steps in the reloading process is the seating of primers in the primer pocket of a casing. Most primers employ a Boxer type construction, which is consists of two components—a cup and an anvil. The cup is on one end of the primer having rounded edges. The anvil is on the opposite end of the primer and has sharp 90 degrees corners. An explosive mixture is located between the cup and the anvil. The Boxer type primers are inserted into a cartridge anvil side first. Thus, it is important to make sure that primers are fed into a primer reloading press with the anvil side up to ensure proper insertion into cartridges.

There are several systems and processes for supplying primers to a reloading press known in the art. A "primer flipper" is a mechanical device consisting of a pan with grooves. Primers transferred into the pan from a primer package are oriented in a random fashion and the pan is then shaken by hand to flip primers such that their anvil side is facing up. Then, a lid is placed over the pan and the primers are transferred to an elongated primer feed tube through a very tedious manual operation, which involves inserting primers into the feed tube by hand one at a time. Some other more advanced primer feed systems known in the art utilize automatic feeding mechanisms wherein the primers are automatically fed into a primer feed tube after being properly positioned either by mechanical or automatic agitation of a feed pan. For example, such systems are described in U.S. Pat. Nos. 4,223,588 and 4,632,008.

However, these known systems and processes suffer from a number of drawbacks. For example, they still utilize a primer feed tube and do not provide for direct feed of primers into a reloading press. Additionally, these systems are not fully automated, still requiring manual operation steps and thus, are not as efficient. Yet further, the known systems do not provide for a continuous primer feed with a uniform feed rate, while at the same time ensuring proper positioning of the primers exiting the feed system.

SUMMARY OF THE INVENTION

Accordingly, it is an objective of the present technology to provide a system and process for feeding primers into a reloading press that provides for a continuous primer feed with uniform feed rate. It is also an objective to provide a system and process for feeding primers into a reloading press that is fully automated and highly efficient. It is further an objective of the present technology to ensure that the primers are properly positioned before entering a reloading press.

To accomplish these objectives, the present technology introduces an oscillating primer feed system. The feed system includes a feed bowl having a first end and a second end, an oscillation mechanism coupled to the feed bowl for imparting an oscillating movement to the feed bowl, and a feed ramp coupled to the second end of the feed bowl for supplying primers from the feed bowl to a cartridge reloading device. The feed system further includes at least one primer position sensor positioned adjacent the feed ramp, wherein the primer position sensor senses orientation of primers in the feed ramp and reports it to the primer feed system.

In certain embodiments, the feed bowl has a longitudinal axis and the oscillation mechanism actuates the feed bowl in a direction substantially perpendicular to the longitudinal axis of the feed bowl. In additional embodiments, the feed bowl has a longitudinal axis and includes a plurality of ribs extending substantially parallel to the longitudinal axis of the feed bowl. In further embodiments, the feed bowl includes at least one deflector extending substantially transversely to the plurality of ribs. In some cases, the oscillation mechanism is driven by an electric motor.

In certain embodiments, the feed bowl has an incline with the second end being lower than the first end. In some of those embodiments, the incline of the feed bowl is in a range of about 1 degree to about 10 degrees.

In additional embodiments, the feed ramp has a first end positioned adjacent the feed bowl and a second end positioned on an opposite end of the feed ramp, and wherein the feed ramp has an incline with the second end being lower than the first end. In some of those embodiments, the feed bowl is inclined at an angle that is smaller than an angle of the incline of the feed ramp. In further embodiments, the incline of the feed ramp is in a range of about 20 degrees to about 40 degrees.

In further embodiments of the primer feed system of the present invention, at least one primer load sensor is positioned adjacent the feed ramp, wherein the at least one primer load sensor senses a level of primer load in the feed ramp and generates a signal corresponding to the sensed primer load level.

In some embodiments, the primer feed system further includes an automatic shut-off mechanism that turns off the primer feed system in response to an improper primer position signal received from the primer position sensor.

The above-stated objective are further achieved by providing a primer feed system that includes a feed bowl having a first end and a second end, an oscillation mechanism coupled to the feed bowl for imparting an oscillating movement to the feed bowl, and a feed ramp coupled to the second end of the feed bowl for supplying primers from the feed bowl to a cartridge reloading device. The feed bowl has in incline with the second end being lower than the first end.

In this embodiment, the primer feed system includes a primer position sensor positioned adjacent the feed ramp, wherein the primer position sensor senses orientation of primers in the feed ramp and reports it to the primer feed system. In further embodiments, the system also has an automatic shut-off mechanism that turns off the primer feed system in response to an improper primer position signal received from the primer position sensor.

Yet another embodiment of the primer feed system of the present invention includes a feed bowl having a first end and a second end and a longitudinal axis, wherein the feed bowl has a plurality of ribs extending substantially parallel to the longitudinal axis of the feed bowl. The system further includes an oscillation mechanism coupled to the feed bowl that imparts an oscillating movement to the feed bowl in a direction substantially perpendicular to the longitudinal axis of the feed bowl, and a feed ramp coupled to the second end of the feed bowl for supplying primers from the feed bowl to a cartridge reloading device.

In certain embodiments, the oscillation mechanism includes a frame with at least one mounting platform slidably coupled to the frame, wherein the at least one mounting platform is coupled to the feed bowl. In some of those embodiments, the frame has at least one rail connected thereto, wherein the at least one mounting platform has a connector that slidably engages with the at least one rail to provide for the oscillating movement of the feed bowl.

Those skilled in the art will appreciate the many alterations possible to the presently described technology. The present technology is not limited to the embodiments and arrangements described above. Other objects of the present technology and its particular features and advantages will become more apparent from consideration of the following drawings and accompanying detailed description.

DETAILED DESCRIPTION OF THE INVENTION

The following detailed description illustrates the technology by way of example, not by way of limitation of the principles of the invention. This description will enable one skilled in the art to make and use the technology, and describes several embodiments, adaptations, variations, alternatives and uses of the invention, including what is presently believed to be the best mode of carrying out the invention. One skilled in the art will recognize alternative variations and arrangements, and the present technology is not limited to those embodiments described hereafter.

Figure 1:
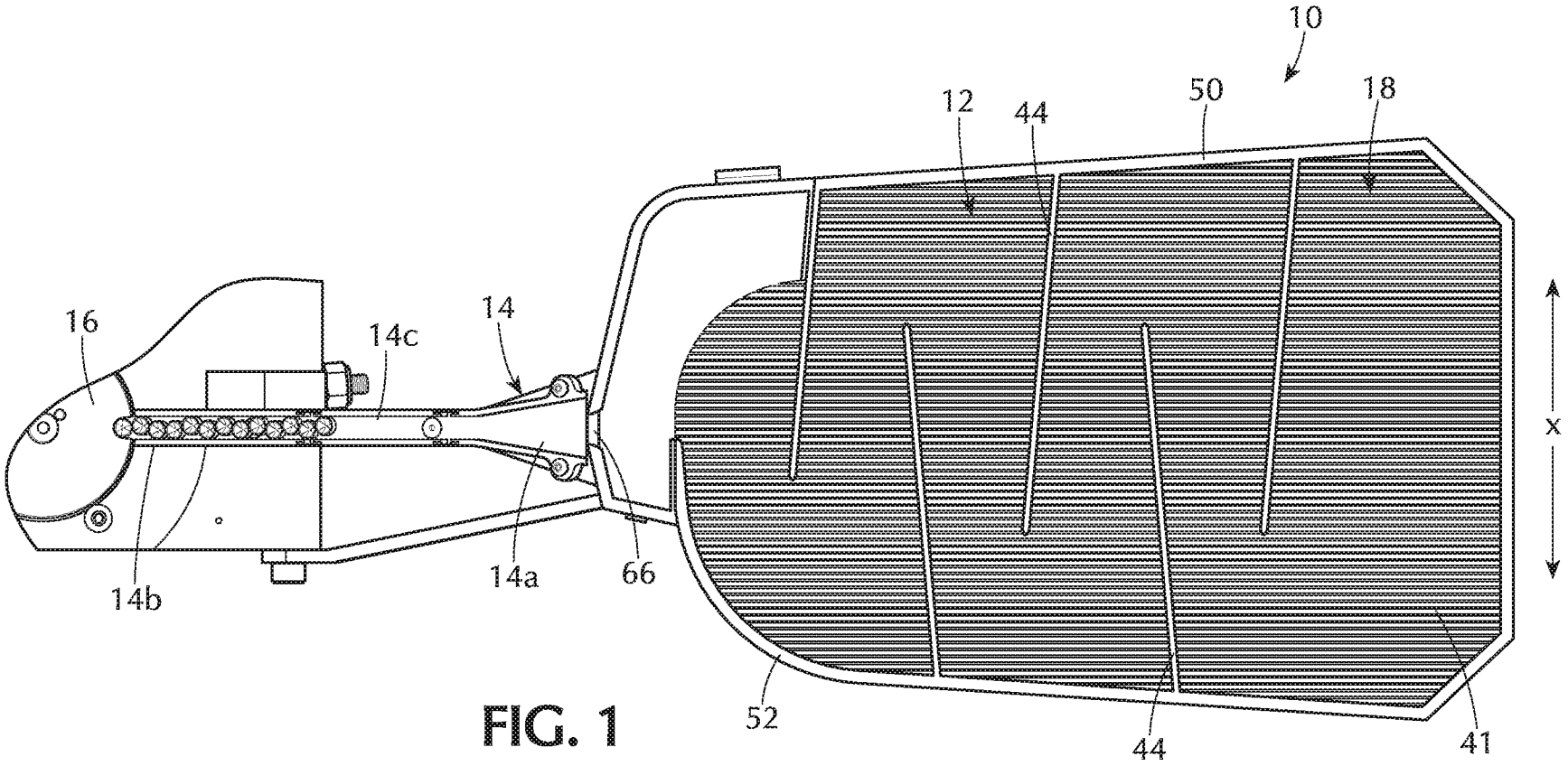
FIG. 1 is top view of the oscillating feed system according to exemplifying embodiments of the present technology.

Referring to the figures in detail and first to FIG. 1, illustrated is an exemplary embodiment of an oscillating primer feed system (10) of the present invention. The system (10) generally includes an oscillating feed bowl (12) connected to a feed ramp (14), which can deliver primers to a feed mechanism (16) that supplies primers to a reloading press. New primers are placed into the oscillating feed bowl (12) in a primer loading area (18). The primers travel down to the other end of the bowl (12) and are fed into a feed ramp (14), from which the primers are moved to the feed mechanism (16) that supplies the primers to a reloading press, where they are inserted into casings. It is noted that the oscillating primer feed system (10) of the present invention can be used with any kind of reloading press or casing press known in the art, including but not limited to a progressive press.

Figure 2:
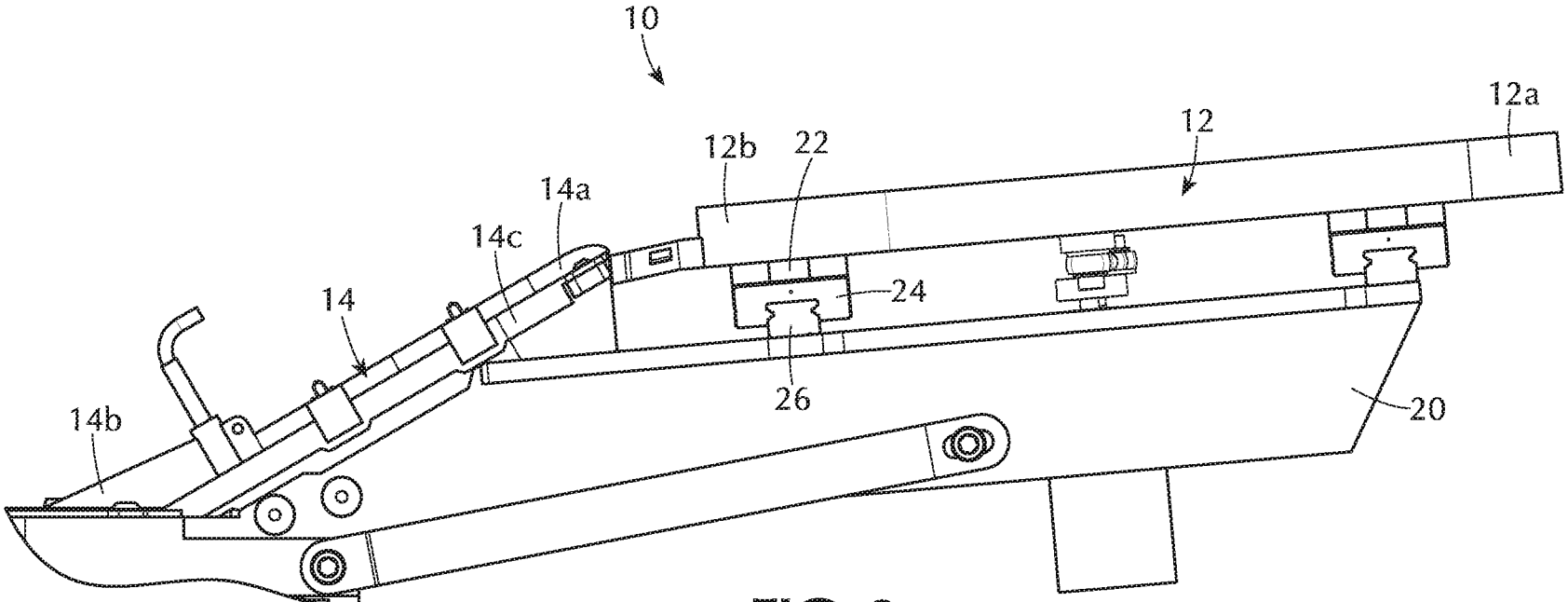
FIG. 2 is a side view of the oscillating feed system according to exemplifying embodiments of the present technology depicted in FIG. 1.

FIG. 2 illustrates a side view of the oscillating primer feed system shown in FIG. 1. As shown in this figure, the oscillating feed bowl (12) is inclined at an angle relative to horizontal, with a second end (12*b*) adjacent the feed ramp (14) being positioned lower than a first end (12*a*) adjacent the primer loading area (18). Any suitable incline angle may be used in accordance with the present invention. In one exemplary embodiment, the oscillating feed bowl (12) is positioned at an incline of between about 1 to about 10 degrees relative to a horizontal surface. Preferably, the incline of the oscillating feed bowl (12) relative to a horizontal surface is about 5 degrees. The incline of the feed bowl (12) facilitates movement of the primers from the loading area (18) to the feed ramp (14).

As further shown in FIG. 2, the feed ramp (14) is also positioned at an incline, wherein a first end (14*a*) adjacent the feed bowl (12) is positioned higher than a second end (14*b*) adjacent the feed mechanism (16). The incline of the feed ramp (14) facilitates further movement of the primers from the feed bowl (12) down the feed ramp (14) and into the feed mechanism (16). In some embodiments, the incline of the feed ramp (14) is steeper than the incline of the feed bowl (12). In additional embodiments, the incline of the feed ramp (14) is about 20 degrees to 40 degrees. In further exemplary embodiments, the incline of the feed ramp (14) is about 30 degrees.

The feed system (10) further includes an oscillation mechanism (20) positioned underneath the oscillating feed bowl (12), as shown in FIG. 2. The oscillation mechanism (20) is coupled to the bottom of the feed bowl (12). The oscillation mechanism (20) functions to oscillate the feed bowl (12) to further facilitate the movement of the primers through the feed system (10) and also to properly position the primer as they travel through the system, as discussed in more detail below.

Figure 3A:
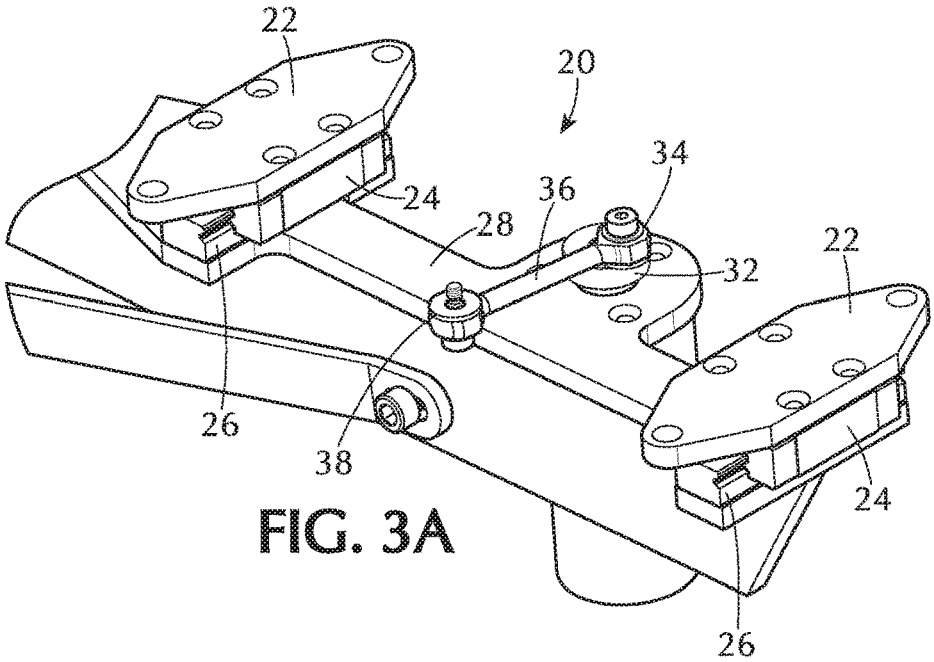
FIG. 3A is a perspective view of the oscillation mechanism according to exemplifying embodiments of the present technology depicted in FIG. 1.
Figure 3B:
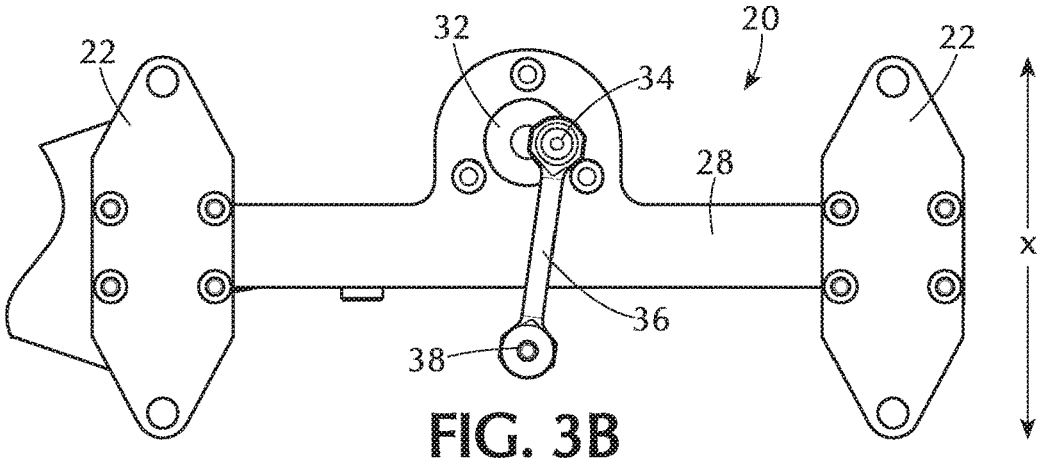
FIG. 3B is a top plan view of the oscillation mechanism according to exemplifying embodiments of the present technology depicted in FIG. 3A.
Figure 3C:
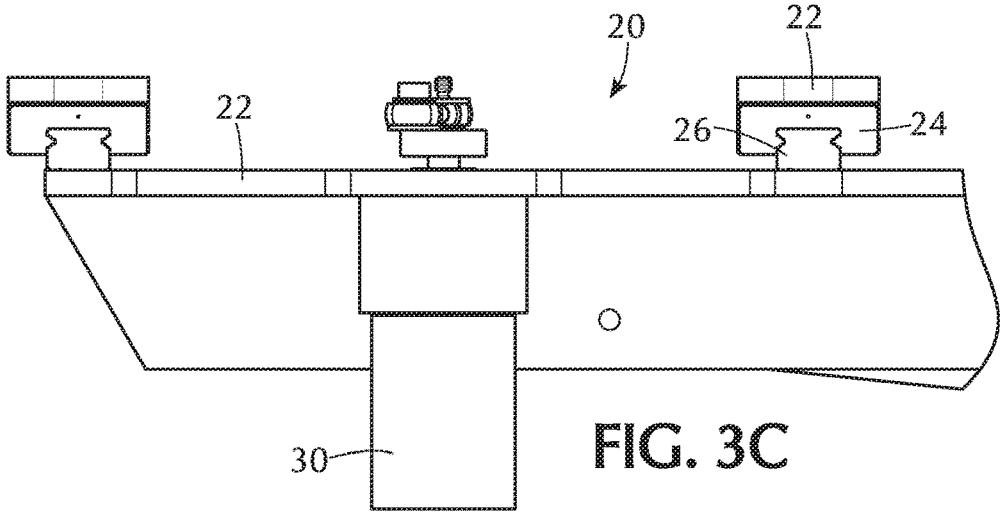
FIG. 3C is a side view of the oscillation mechanism according to exemplifying embodiments of the present technology depicted in FIG. 3A.

Referring next to FIGS. 3A-3C, an exemplary embodiment of the oscillation mechanism (20) is illustrated.

Two mounting platforms (22) are attached to the bottom of the feed bowl (12), as shown in FIG. 2, and provide for a coupling between the bowl (12). The mounting platforms (22) are each coupled to a slotted connector (24) positioned underneath each of the platforms (22). The slots in the slotted connectors (24) are in turn mounted to linear rails (26) mounted on carriage (28). The slotted connectors (24) slide on the linear rails (26) to provide for a back-and-forth oscillating movement of the feed bowl (12) in the direction indicated as "X" in FIG. 1 when driven by the motor (30) as further discussed below.

The motor (30) is a DC motor of any suitable type known in the art. The motor preferably has an adjustable speed, which in one exemplary embodiment is between about 30 RPM to about 400 RPM, which translates to about 30 to 400 oscillations per minute. Desirably the motor provides about 120 RPM. The motor speed is adjustable either manually or automatically based on a size of primers being fed into the system (10). For example, if larger size primers are being used with the system (10), the motor can be adjusted to a faster speed to better facilitate the movement of the primers through the system. Other motor speeds may also be used with the system of the present invention if desired, depending on size and type of primers, as well as efficiency and speed of the feed system.

The motor (30) is coupled to a slider-crank mechanism that translates circular motion of the motor to reciprocating movement of the feed bowl 12. An annular hub (32) is mounted to the drive shaft of motor (30). A hinge pin (34) extends upwardly from the annular hub (32). Hinge pin (34), as seen in FIGS. 3A-3C, may optionally be in the form of a bolt or carriage bolt that is threaded into a mating threaded aperture in the annular hub (32). A linkage (36) having apertures at each end is mounted to hinge pin (34), with the hinge pin (34) received in an aperture at one end of the linkage (36). The aperture at the other end of linkage (36) is mounted to another hinge pin (38) which extends downwardly from the feed bowl (12). Hinge pin (38), as seen in FIGS. 3A-3C, may optionally be in the form of a bolt or carriage bolt that is threaded into the aperture of a mating threaded mounting block in the bottom of feed bowl (12).

When motor (30) is operated, it rotates the annular hub (32), which in turn moves hinge pin (34) in a circular path. This circular path movement is translated into reciprocating movement of the linkage (36) thereby providing oscillating movement of the feed bowl (12). When reciprocating movement of the linkage (36) is activated and the feed bowl (12) oscillates, the slotted connectors (24) slide on the linear rails (26).

It is noted that other suitable types of motors and oscillation mechanism components known to those skilled in the art may be utilized in accordance with the present invention.

Figure 4:
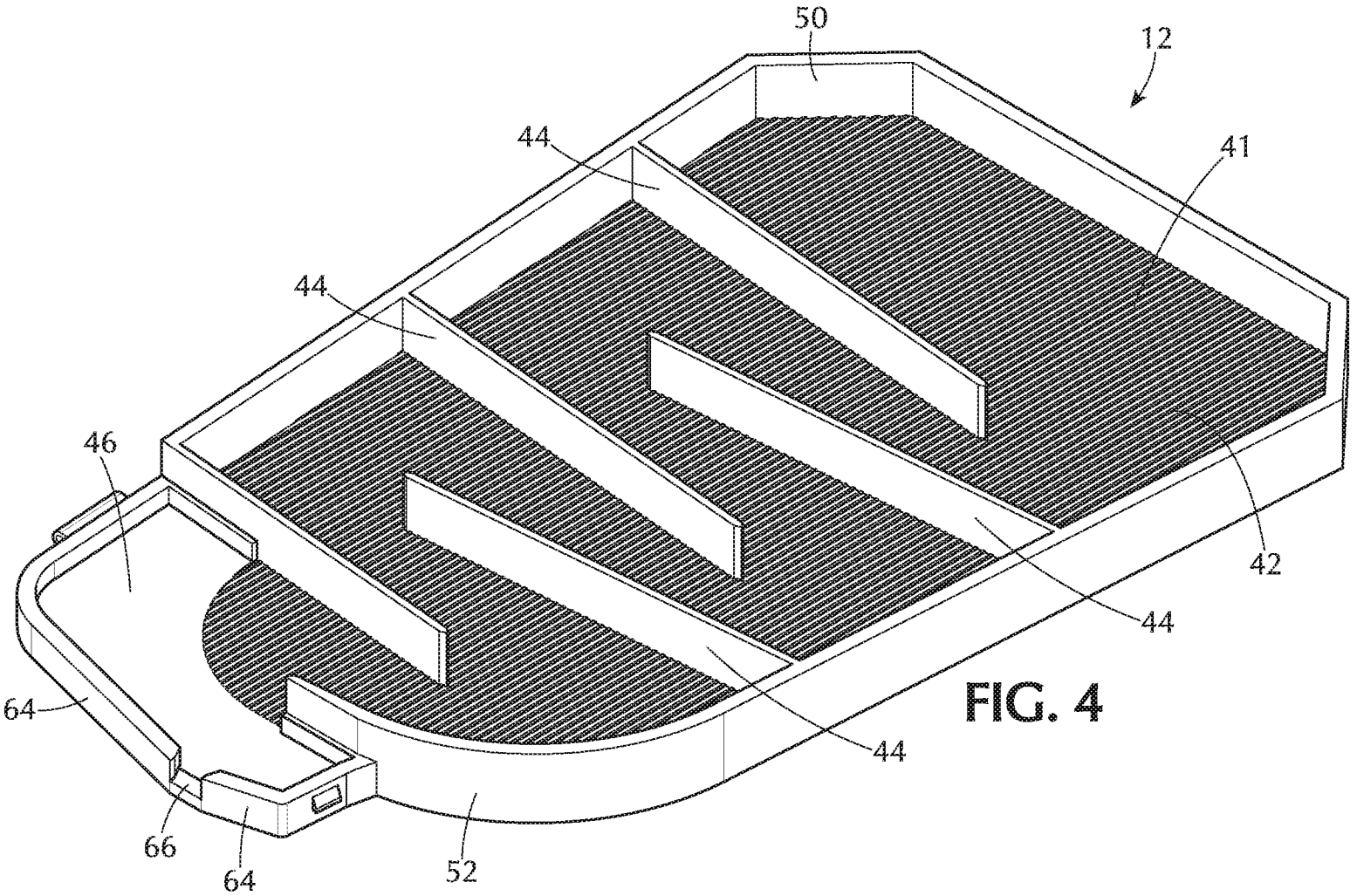
FIG. 4 is a top perspective view of the primer feed bowl according to exemplifying embodiments of the present technology depicted in FIG. 1.

Referring next to FIG. 4, an exemplary embodiment of the feed bowl (12) according to the present invention is illustrated. The feed bowl (12) has a substantially planar lower surface (41) having a plurality of ribs (42) extending parallel to each other and to a longitudinal axis of the feed bowl and a sidewall (50) surrounding the lower surface (41). Preferably, the ribs extend from the first end (12*a*) to the second end (12*b*) of the bowl, with exception of the collection area (46) adjacent the feed mouth (48) leading to the feed ramp (14). The plurality of ribs (42) assist in positioning the primers in a correct orientation, as described in more detail below. The feed bowl (12) sidewall (50) extends along the perimeter of the bowl to prevent primers from falling off the bowl during their movement towards the feed ramp (14)

Figure 5B:
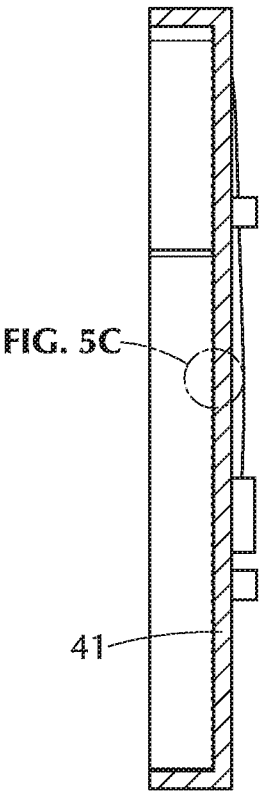
FIG. 5B is a cross-sectional view of the primer feed bowl according to exemplifying embodiments of the present technology depicted in FIG. 5A, taken along the line "A-A".
Figure 5A:
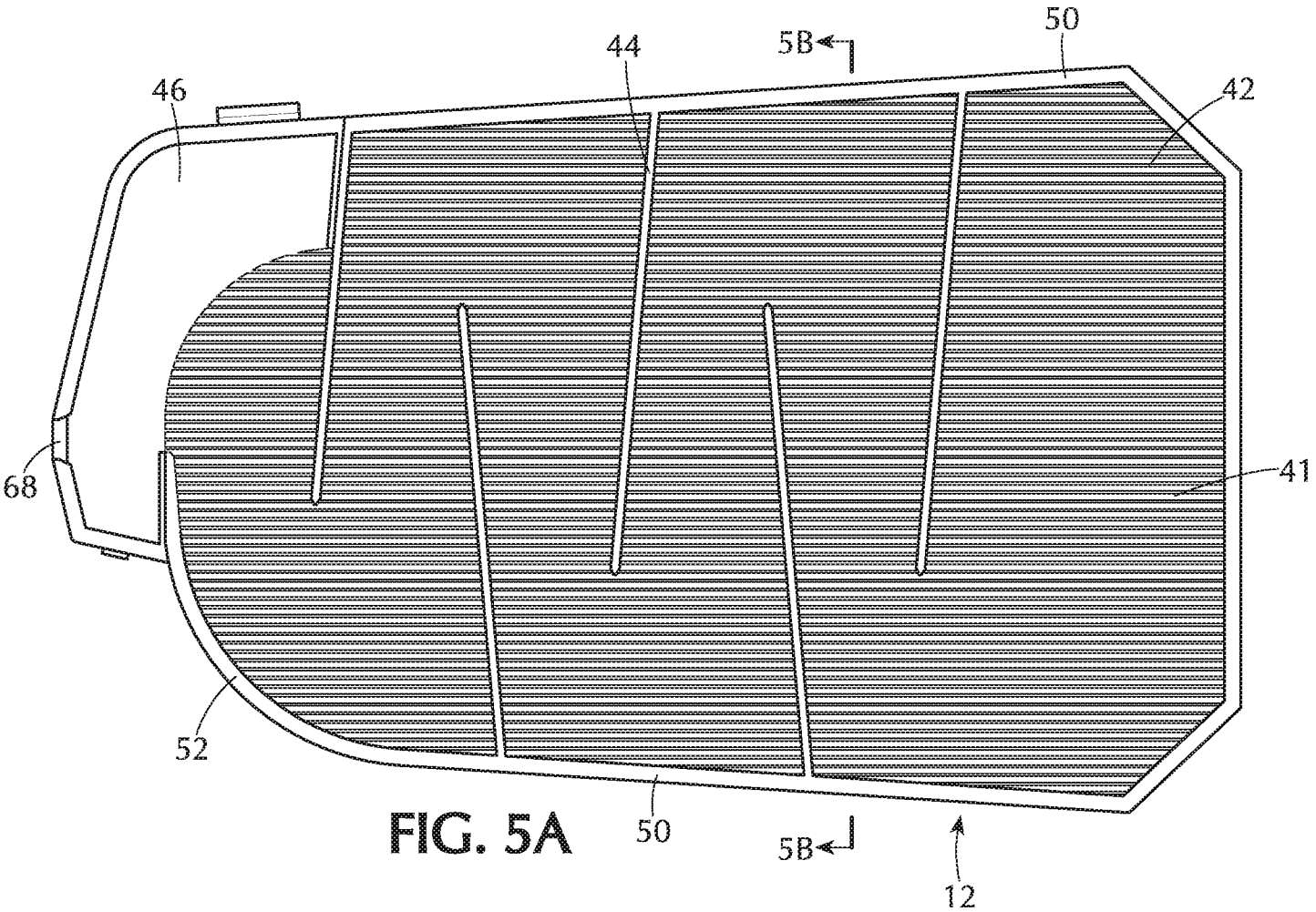
FIG. 5A is a top view of the primer feed bowl according to exemplifying embodiments of the present technology depicted in FIG. 4.
Figure 5C:
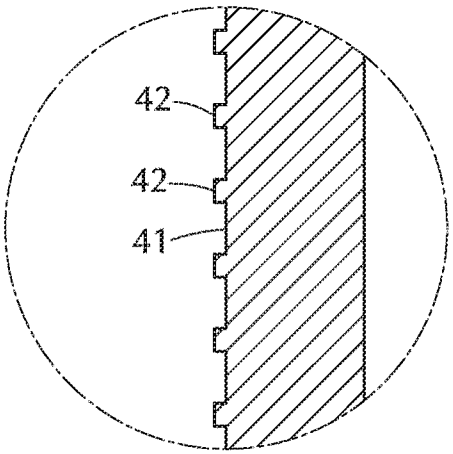
FIG. 5C is an enlarged view of area labeled "B" of the primer feed bowl according to exemplifying embodiments of the present technology depicted in FIG. 5B.

The feed bowl (12) further includes a plurality of deflectors (44) positioned along the length of the bowl. The deflectors (44) extend across the feed bowl, extending from the sidewalls (50) nearly perpendicular to the plurality of ribs (42) but angled toward the second end (12*b*) of the bowl. The length of each deflector (44) is less than the width of the bowl (12) such that there is room for primers to move past each deflector and down the bowl towards the feed ramp (14). The deflectors extend from the sidewalls (50) of the feed bowl in an alternating fashion, as shown in FIG. 5A. This way, the primers that are placed in the bowl in the primer loading area (18) travel to the opposite end of the bowl through a serpentine pathway created by the deflectors (44). The deflectors (44) function to direct the movement of the primers through the feed bowl to allow for the ribs (42) to act on the primers to correctly orient them. It is noted that the number, shape and positioning of the deflectors shown in FIG. 4 is only exemplary and that different number, shape and positioning of the deflectors may be used in accordance with the present invention. In one exemplary embodiment, a height of the sidewall (50) is substantially the same as a height of the deflectors (44).

FIGS. 5A-5D illustrate further details of the feed bowl (12). As seen in FIG. 5A and a cross-sectional view in FIG. 5C, the ribs (42) are substantially linear and extend parallel to the longitudinal axis of the feed bowl. A width of each rib, as well as a distance between adjacent ribs, can be adjusted based on a particular size of primers being used with the feed system to allow for maximum effectiveness and efficiency of the system. In one exemplary embodiment, the ribs the width of each rib (42) is about 0.015 inch to about 0.03 inch (preferably about 0.02 inch) and the distance between the centers of adjacent ribs is greater than the width of each rib but less than the diameter of the primer—preferably about 0.05 inch to about 0.125 inch (and most preferably about 0.07 inch). The height of the ribs (42) is about 0.01 inch. The ribs preferably have a generally rectangular cross-section but may have other cross-sectional shapes sufficient to provide for reorientation of primers as described hereafter.

Figure 5D:
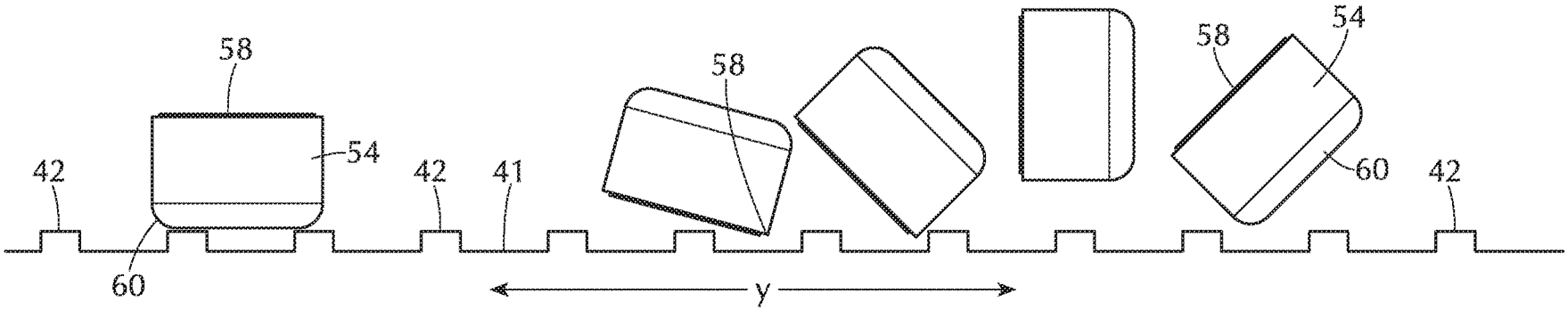
FIG. 5D is a side view of the primer feed bowl according to exemplifying embodiments of the present technology depicted in FIG. 4, showing movement of the primers through the feed bowl.
Figure 6B:
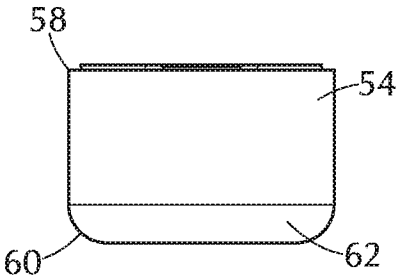
FIG. 6B is a side view of the primer depicted in FIG. 6B.
Figure 6A:
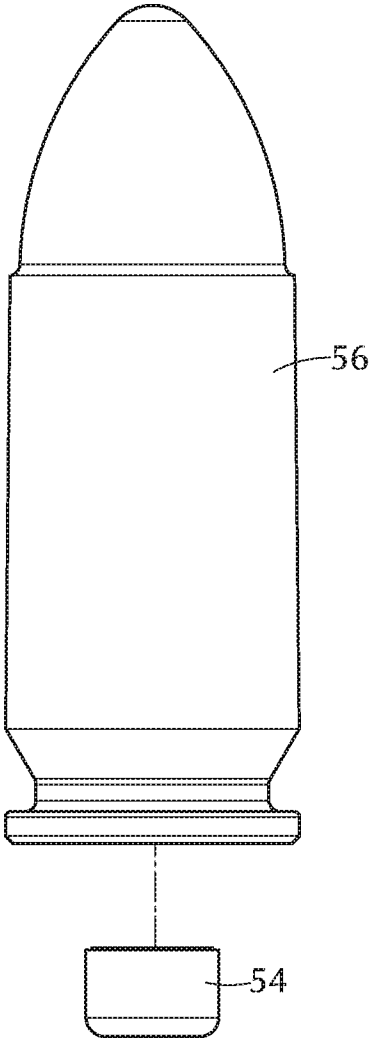
FIG. 6A illustrates a typical cartridge with a primer used in the system according to exemplifying embodiments of the present technology depicted in FIG. 1.

FIG. 5D illustrates motion of the primers as they travel along the feed bowl (12). A typical primer usually has two sides—an example of a primer (54) is illustrated in FIG. 6B. The primer (54) includes a top side (58), which has a sharp edge, and a bottom side (60), which has a curved edge. Main mass (62) of the primer (54) is located adjacent the bottom side (60). As shown in FIG. 6A, when the primer (54) is inserted into a cartridge (56), the top side (58) of the primer is inserted first. Therefore, before primers are fed to a press, where they are inserted into casings, it is desirable to have all primers positioned with their top side facing up such that they can be properly inserted into the cartridges. The objective of the feed system of the present invention is to position the primers (54) with their top side up as they exit the feed bowl (12) and travel through the feed ramp (14) to the feed mechanism (16) that supplies the primers to a reloading press.

Referring back to FIG. 5D, when the primers (54) travel along the feed bowl (12), which is being oscillated, the primers (54) flip from their top side to the bottom side and vice versa. The oscillating motion of the bowl in a direction substantially perpendicular to longitudinal axes of the ribs (referenced by "Y" in FIG. 5D) causes the primers to tumble between the ribs (42) and flip to a correct orientation. When a primer is in an upside-down position—with the bottom side (60) pointing up—the primer will catch a rib (42) with the sharp edge, forcing the primer to tumble and flip. Once the primer is positioned with its bottom side (60) pointing down, it will most likely stay in that orientation as it travels down the feed bowl, because there is no sharp edge on the bottom side to catch on the ribs.

As shown in FIG. 5A, the second end (12*b*) of the feed bowl (12) has a curved wall area (52). This is provided to facilitate the movement of the primers around the last deflector (44) and into the no-ribs area (46) downstream from the curved wall area (52) and to the opening (66) that leads to the upper end (14*a*) of feed ramp (14). The no-ribs area (46) has a smooth surface which prevents the primers from further flipping, once they are positioned in the correct orientation with the bottom side pointing down, before they enter the feed ramp (14).

Figure 7:
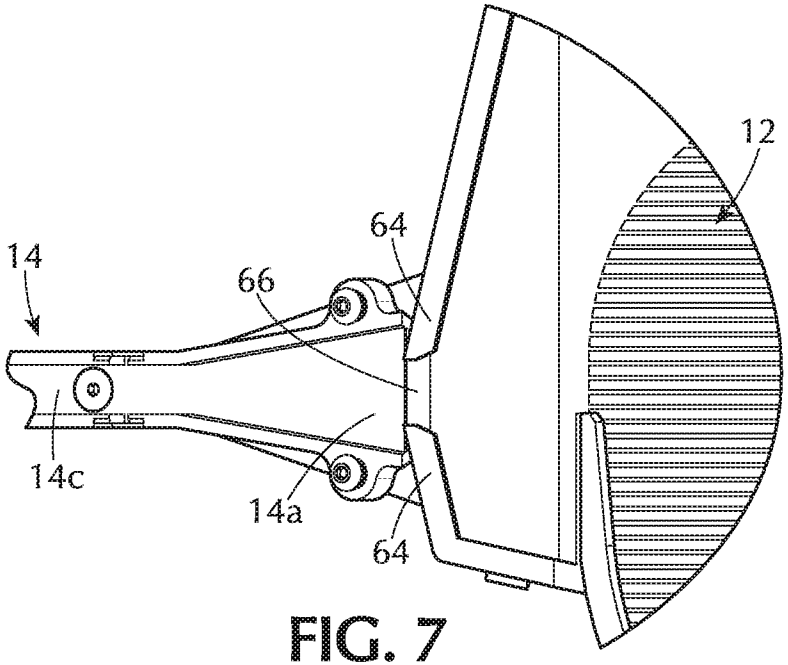
FIG. 7 is an enlarged partial view of the feed bowl and the feed ramp according to exemplifying embodiments of the present technology depicted in FIG. 1, showing details of the feed mouth.

FIGS. 1 and 7 illustrate details of the transition of the feed bowl (12) to the feed ramp (14). An opening (66) is provided in the sidewalls (64) of the feed bowl. Preferably, the sidewalls (64) taper inwardly in the direction of the feed ramp to create a funnel that directs the primers from the feed bowl (12) to the opening (66). Immediately adjacent opening (66) is the upper end (14*a*) of feed ramp (14). The opening (66) has a width that is selected to pass a primer through the opening (66). In general, the width of the opening (66) will be a minimum of a primer diameter plus two times a standard manufacturing deviation, or more preferably, about 1.05 to about 1.25 times the primer diameter. It is noted that a larger width opening (66) may still be used with smaller size primers. In additional exemplary embodiments, the width of the opening (66) may be adjustable depending on the primer size.

The upper end (14*a*) of the feed ramp (14) has a width at its open end that is wider than opening (66). The width of the upper end (14*a*) of the feed ramp is sufficiently wide so that as the feed bowl (12) oscillates the opening (66) will always be adjacent a portion of the upper end (14*a*) of the feed ramp (14) and therefore able to release primers from the feed bowl (12) to the upper end (14*a*) of the feed ramp (14). The width of the upper end (14*a*) of the feed ramp (14) is tapered from its widest area at the open end adjacent the opening (66) to a narrower chute (14*c*) so as to funnel primers received in the upper end (14*a*) of the feed ramp (14) into the chute (14*c*). Chute (14*c*) has a width that is greater than the primer diameter. Preferably, the chute (14*c*) has a minimum width which is a primer diameter plus two times a standard manufacturing deviation, or more preferably, about 1.05 times to about 1.35 times the primer diameter.

Figure 8:
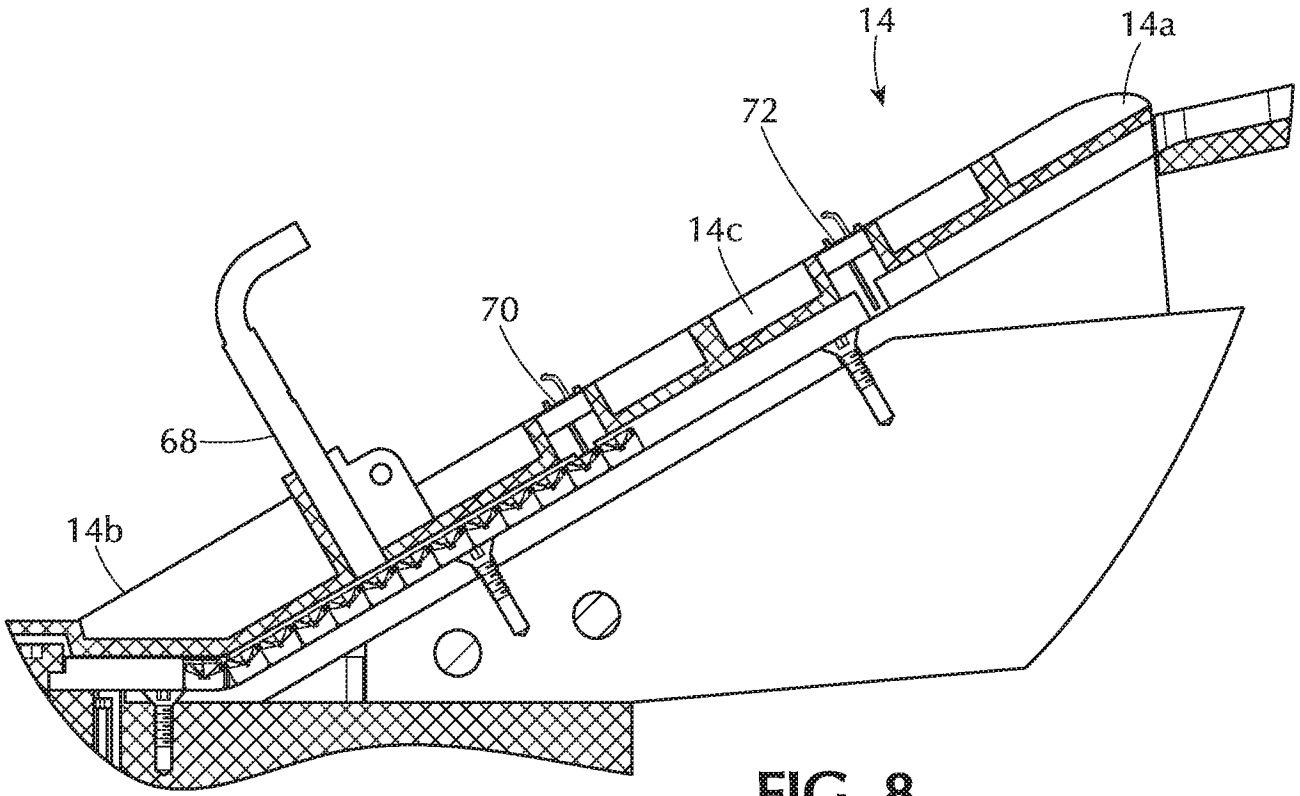
FIG. 8 is a side view of the feed ramp according to exemplifying embodiments of the present technology depicted in FIG. 1.

Referring next to FIG. 8, the feed ramp (14) is shown in more detail. The feed ramp includes a first primer load sensor (72) and a second primer load sensor (70) positioned downstream from the first primer load sensor in the chute (14*c*). The sensors (72, 70) function to detect a presence of primers in the feed ramp (14). Many kinds of sensors are known in the art and may be used in the system of the present invention. In one exemplary embodiment, optical sensors are used as the primer load sensors (72, 70). A typical optical sensor sends a ray of light into an object and generates a signal when the light ray is deflected or interrupted by an object.

Each of the sensors (72, 70) detect presence of primers at that particular location in the feed ramp (14) and generate a signal corresponding to whether primers are detected or not. A positive detection signal from the first primer load sensor (72) indicates that there is a sufficient number of primers in the feed ramp, which in turn signals the system to stop the oscillation mechanism and thus stop the primer feed into the ramp. A negative detection signal from the second primer load sensor (70) indicates low primer count in the feed ramp (14), which signals to the system operate the oscillation mechanism and thereby resume feeding the primers into the feed ramp. The sensors (72, 70) can either continuously monitor the presence of primers in the feed ramp or monitor in certain intervals of time.

The positioning of the first and second primer load sensors (72, 70) is chosen depending on the desirable high and low amount of primers in the feed ramp. For example, if the first sensor (72) is positioned closer to the first end (14*a*) of the feed ramp, the system will allow for a higher number of primers in the feed ramp before shutting off the primer feed. On the other hand, if the second sensor (70) is positioned closer to the second end (14*b*) of the feed ramp, the system will allow before resuming the primer feed.

Figure 9A:
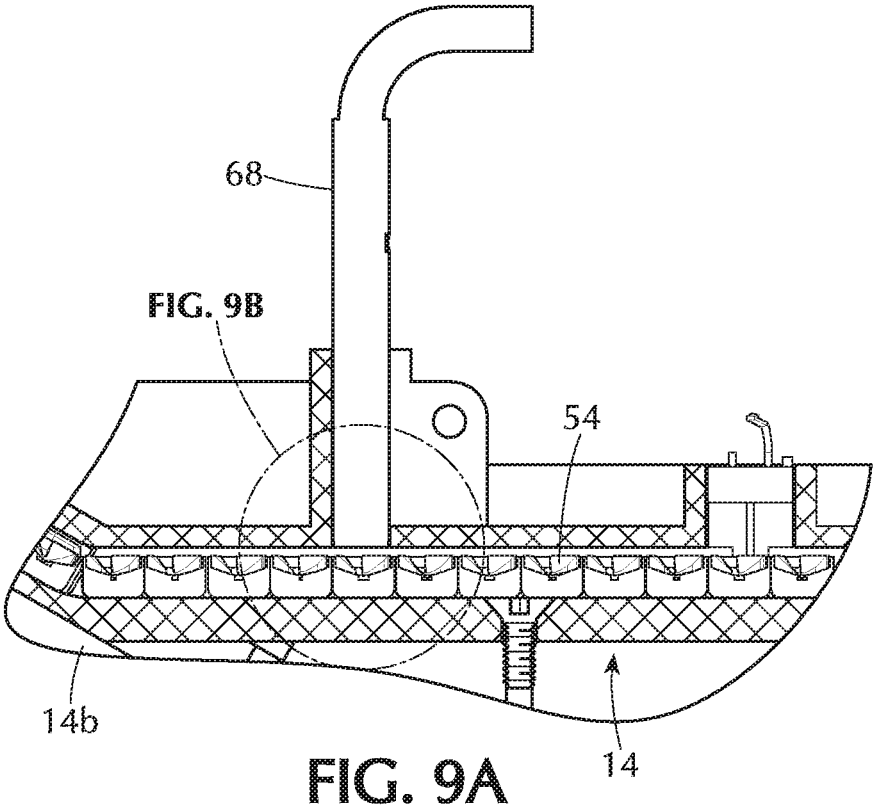
FIG. 9A is an enlarged partial view of the feed ramp depicted in FIG. 8, showing details of the primer position sensor.
Figure 9B:
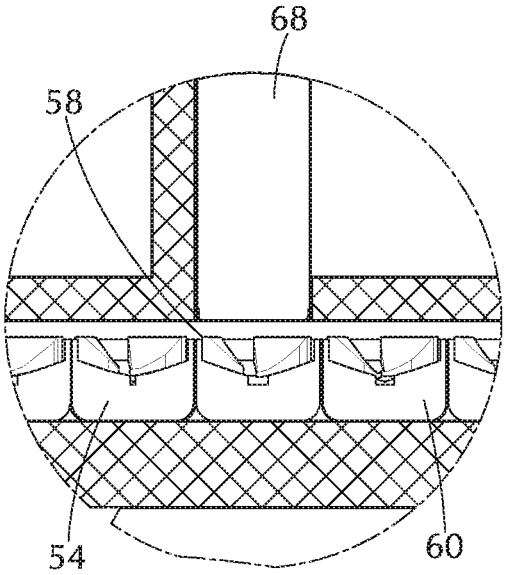
FIGS. 9B and 9C are enlarged partial views of the primer position sensor depicted in FIG. 9A.
Figure 9C:
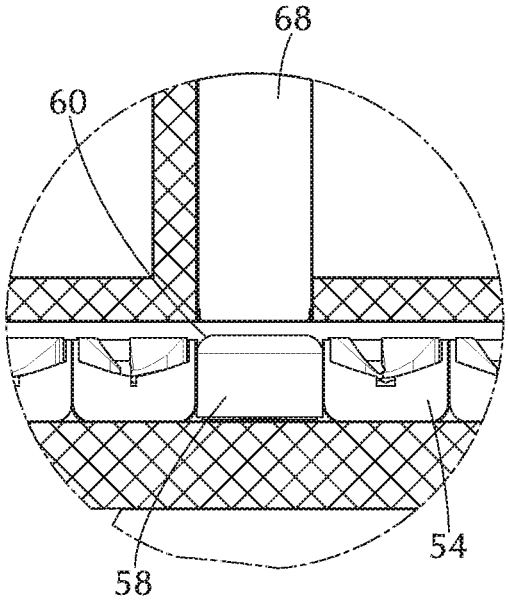

The feed ramp further includes a primer position sensor (68), preferably placed downstream from the second primer load sensor (70) in the direction of the second end (14*b*) of the feed ramp. The primer position sensor (68) functions to sense whether primers in the feed ramp (14) are positioned in the correct top side-up orientation. FIGS. 9A-9C illustrate operation of the primer position sensor in more detail. The primer position sensor (68) is placed adjacent the second end (14B) of the feed ramp (14). The sensor (68) determines the positioning of each primer (54) as it passes underneath the sensor and before it enters the feed mechanism (16).

Preferably, the primer position sensor (68) is an inductive proximity sensor, which operates by using electromagnetic induction to detect metal objects in a non-contact way. In particular, as shown in FIG. 6B, primers typically contain main mass adjacent the bottom side (60) of the primer. Thus, the bottom portion of the primer contains the most metallic material. An inductor contained in the primer position sensor (68) develops a magnetic field when a current flows through it. This generated magnetic field interacts with a target object, in this case a primer, which acts as a conductor due to its metallic properties. This interaction is recorded by the sensor, which outputs a signal based on the magnitude of the interaction.

When the primers (54) are correctly oriented with their top side (58) facing up, as shown in FIG. 9B, there is no metallic face to sense and the primer position sensor (68) provides an appropriate output signaling that.

In other instances, as shown in FIG. 9C, when a primer is positioned in a wrong orientation with its bottom side (60) facing up, the sensor (68) senses a metallic face of the primer. This causes the sensor (68) to generate an output signal that causes one or more of (i) a system alarm alerting a user of an incorrectly positioned primer, and (ii) an automatic shutoff of one or more of the primer feed system (10), the feed mechanism (16), and the associated reloading press.

A distance between a bottom surface of the primer position sensor (68) and the top surface of the primers (54) is such that it can accommodate various sizes of primers used with the system. In some embodiments, the distance between the primer position sensor (68) and the primers (54) is adjustable, either manually or automatically, based on a size of primers used with the system. It is noted that other types of object detection sensors may be used as the primer position sensor (68) in accordance with the present invention.

In one embodiment, if the primer position sensor (68) senses an improperly oriented primer the primer position sensor (68) generates a signal which is different from a signal generated by the primer position sensor (68) when a properly oriented primer is sensed by the primer position sensor (68).

In one embodiment, the sensor (68) generate an output signal that triggers a system alarm alerting a user of the incorrectly positioned primer, and the user can manually shut down the primer feed system.

In another embodiment, the sensor (68) generate an output signal that automatically shuts down one or more of the primer feed system (10), the feed mechanism (16), and the associated reloading press.

Accordingly, the primer feed system of the present invention ensures that all primers fed into the cartridge press through the feed mechanism (16) are in a correct orientation to be inserted into cartridges.

While the present technology has been described with reference to particular embodiments and arrangements of parts, features, and the like, the present technology is not limited to these embodiments or arrangements. Indeed, many modifications and variations will be ascertainable to those of skill in the art, all of which are inferentially included in these teachings.

What is claimed is:

1. A primer feed system, comprising:

a feed bowl having a first end and a second end and a left side and a right side, the feed bowl having a lower planar surface and a sidewall extending around the first end, left side, second end and right side, and a longitudinal axis, and a plurality of spaced part ribs extending substantially parallel to the longitudinal axis of the feed bowl, and one or more deflectors extending transversely from the sidewall and angled toward the second end of the feed bowl and having a length which is less than a width of the bowl;

the first end of the feed bowl being higher than the second end of the first end whereby the feed bowl is inclined at an angle from the first end to the second end;

an oscillation mechanism coupled to the feed bowl for imparting an oscillating movement to the feed bowl which is generally perpendicular to the longitudinal axis of the feed bowl;

an inclined feed ramp extending from the second end of the feed bowl;

at least one primer position sensor positioned adjacent the feed ramp, wherein the primer position sensor senses orientation of primers in the feed ramp.

2. The primer feed system of claim 1, whereby oscillating movement of the feed bowl causes incorrectly-oriented primers provided in the feed bowl to tumble between the ribs and flip to a correct orientation.

3. The primer feed system of claim 1, wherein if the primer position sensor senses an improperly oriented primer the primer position sensor generates a signal which is different from a signal generated by the primer position sensor when a properly oriented primer is sensed by the primer position sensor.

4. The primer feed system of claim 1, further comprising at least one primer load sensor positioned adjacent the feed ramp for sensing primers in the feed ramp.

5. The primer feed system of claim 4, wherein the oscillation mechanism is activated if a primer load sensor does not sense a primer in the feed ramp.

6. The primer feed system of claim 4, wherein the oscillation mechanism is stopped if a primer load sensor senses a primer in the feed ramp.

7. The primer feed system of claim 1, wherein the oscillation mechanism comprises:

an electric motor having a driveshaft; and a slider-crank mechanism including an annular hub connected to the driveshaft of the electric motor, a motor hinge pin extending from the annular hub, a bowl hinge pin extending from the feed bowl, and a linkage having apertures at each end thereof attached to the motor hinge pin and the bowl hinge pin.

8. The primer feed system of 7 further comprising one or more slotted connectors and mating linear rails located below the feed bowl, whereby the feed bowl oscillates during sliding movement of the slotted connectors with the mating linear rails.

9. The primer feed system of claim 8, wherein:

the feed bowl has one or more slotted connectors affixed to a bottom surface thereof with the slot thereof extending generally perpendicular to the longitudinal axis of the feed bowl;

one or more linear rails are located below the feed bowl with the slotted connector mounted thereon;

whereby when the oscillation mechanism is activated, the feed bowl oscillates, and the slotted connectors slide on the linear rails.

10. The primer feed system of claim 1, wherein the feed bowl is inclined from the first end to the second end at an angle of between 1 to 10 degrees relative to a horizontal plane.

11. The primer feed system of claim 10, wherein the feed bowl is inclined from the first end to the second end at an angle of 5 degrees.

12. The primer feed system of claim 10, wherein feed ramp is inclined at an angle of between 20 degrees to 40 degrees.

13. The primer feed system of claim 4, further comprising a shutdown signal generator triggered by an improper primer position signal received from the primer position sensor.

14. The primer feed system of claim 1, wherein the ribs in the feed bowl have a width of between 0.015 inch to 0.03 inch and a distance between the centers of adjacent ribs of 0.05 inch to 0.125 inch.

15. The primer feed system of claim 14, wherein the ribs in the feed bowl have a width of 0.02 inch and a distance between the centers of adjacent ribs of 0.07 inch.

16. A primer feed system, comprising:

a feed bowl having a first end and a second end and a left side and a right side, the feed bowl having a lower planar surface and a sidewall extending around the first end, left side, second end and right side, and a longitudinal axis, and a plurality of spaced part ribs extending substantially parallel to the longitudinal axis of the feed bowl, and one or more deflectors extending transversely from the sidewall and angled toward the second end of the feed bowl and having a length which is less than a width of the bowl;

the first end of the feed bowl being higher than the second end of the first end whereby the feed bowl is inclined at an angle from the first end to the second end at an angle of between 1 to 10 degrees;

an oscillation mechanism coupled to the feed bowl for imparting an oscillating movement to the feed bowl which is generally perpendicular to the longitudinal axis of the feed bowl;

whereby oscillating movement of the feed bowl causes incorrectly-oriented primers provided in the feed bowl to tumble between the ribs and flip to a correct orientation;

an inclined feed ramp extending from the second end of the feed bowl;

at least one primer position sensor positioned adjacent the feed ramp, wherein the primer position sensor senses orientation of primers in the feed ramp;

at least one primer load sensor positioned adjacent the feed ramp for sensing primers in the feed ramp, wherein the oscillation mechanism is activated if a primer load sensor does not sense a primer in the feed ramp, and the oscillation mechanism is stopped if a primer load sensor senses a primer in the feed ramp.

17. The primer feed system of claim 16, wherein the oscillation mechanism comprises:

an electric motor having a driveshaft; and a slider-crank mechanism including an annular hub connected to the driveshaft of the electric motor, a motor hinge pin extending from the annular hub, a bowl hinge pin extending from the feed bowl, and a linkage having apertures at each end thereof attached to the motor hinge pin and the bowl hinge pin.

18. The primer feed system of 17 further comprising one or more slotted connectors and mating linear rails located below the feed bowl, whereby the feed bowl oscillates during sliding movement of the slotted connectors with the mating linear rails.

19. The primer feed system of claim 18, wherein:

the feed bowl has one or more slotted connectors affixed to a bottom surface thereof with the slot thereof extending generally perpendicular to the longitudinal axis of the feed bowl;

one or more linear rails are located below the feed bowl with the slotted connector mounted thereon;

whereby when the oscillation mechanism is activated, the feed bowl oscillates, and the slotted connectors slide on the linear rails.

20. The primer feed system of claim 17, wherein the feed bowl is inclined from the first end to the second end at an angle of 5 degrees.

21. The primer feed system of claim 19, wherein feed ramp is inclined at an angle of between 20 degrees to 40 degrees.

22. The primer feed system of claim 16, wherein if the primer position sensor senses an improperly oriented primer the primer position sensor generates an improper primer position signal, thereby activating a shutdown signal.

23. The primer feed system of claim 16, having two primer load sensors, a first primer load sensor nearer an end of the inclined feed ramp for activating the oscillation mechanism if the first primer load sensor does not sense a primer in the feed ramp, and a second primer load sensor nearer an entrance of the inclined feed ramp for stopping the oscillation mechanism if the second primer load sensor senses a primer in the feed ramp.

* * * * *